United States Patent [19]

Börner

[11] 4,120,089

[45] Oct. 17, 1978

[54] VEGETABLE AND FRUIT-SLICING UTENSILS

[76] Inventor: Alfred Börner, Pickliessemer Str. 3, 5521 Dudeldorf, Fed. Rep. of Germany

[21] Appl. No.: 778,597

[22] Filed: Mar. 17, 1977

[30] Foreign Application Priority Data

Mar. 20, 1976 [DE] Fed. Rep. of Germany ..... 2611879
Mar. 24, 1976 [DE] Fed. Rep. of Germany ..... 2612362

[51] Int. Cl.[2] ..... B26B 3/00

[52] U.S. Cl. ..... 30/278; 30/283; 30/304

[58] Field of Search ..... 30/283, 278, 304

[56] References Cited

FOREIGN PATENT DOCUMENTS 1,273,759 9/1967 Fed. Rep. of Germany ..... 30/278

*Primary Examiner*—James L. Jones, Jr.

*Assistant Examiner*—Joseph Thomas Zatarga

*Attorney, Agent, or Firm*—Robert W. Beach; Ward Brown

[57] ABSTRACT

A slicer has two parallel rails, a removable front plate arranged between the rails, the lower surface of the front plate lying parallel to and at a distance beneath and in front of the upper surface of the back plate, and a blade arranged between the two plates; the blade has a cutting edge at least part of which lies in the same plane as the surface of the back plate. The underside of the front plate has bearers each containing at least one step, the bearers being supported on supporting ledges which project inwardly from the rails when the front plate is inserted. The cutting blade may be corrugated. In manufacturing the utensil, a suitable plastics material is injection-moulded in a single operation onto the cutting blade which has been previously inserted into the mould.

20 Claims, 15 Drawing Figures

Fig. 6
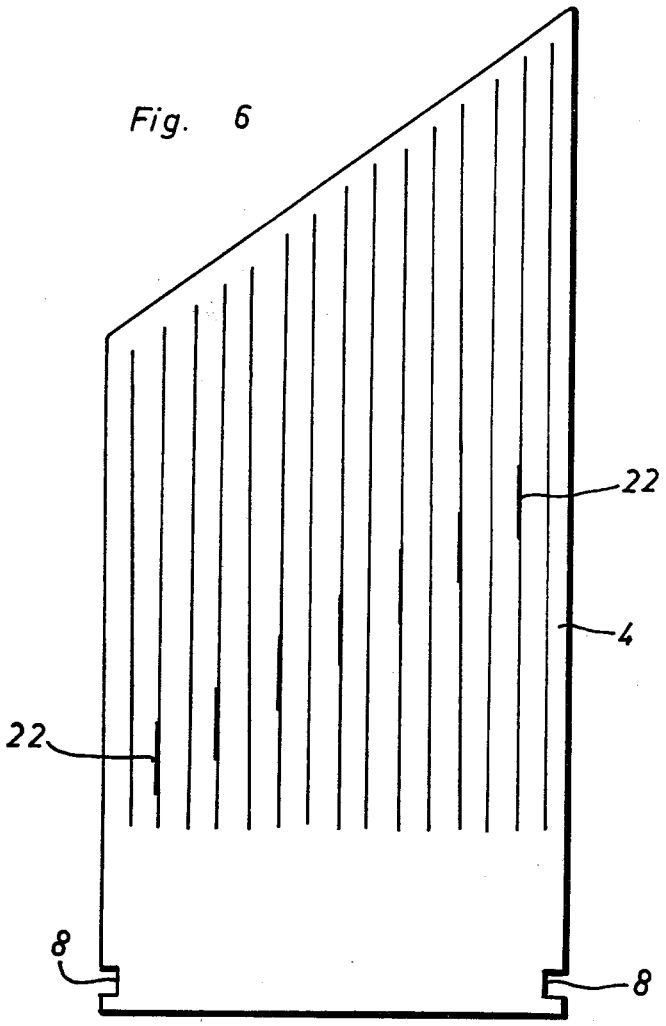
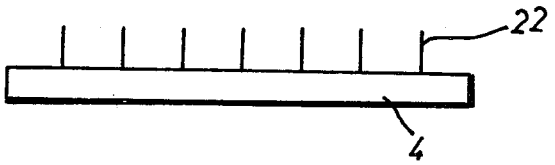
Fig. 7

Fig. 8
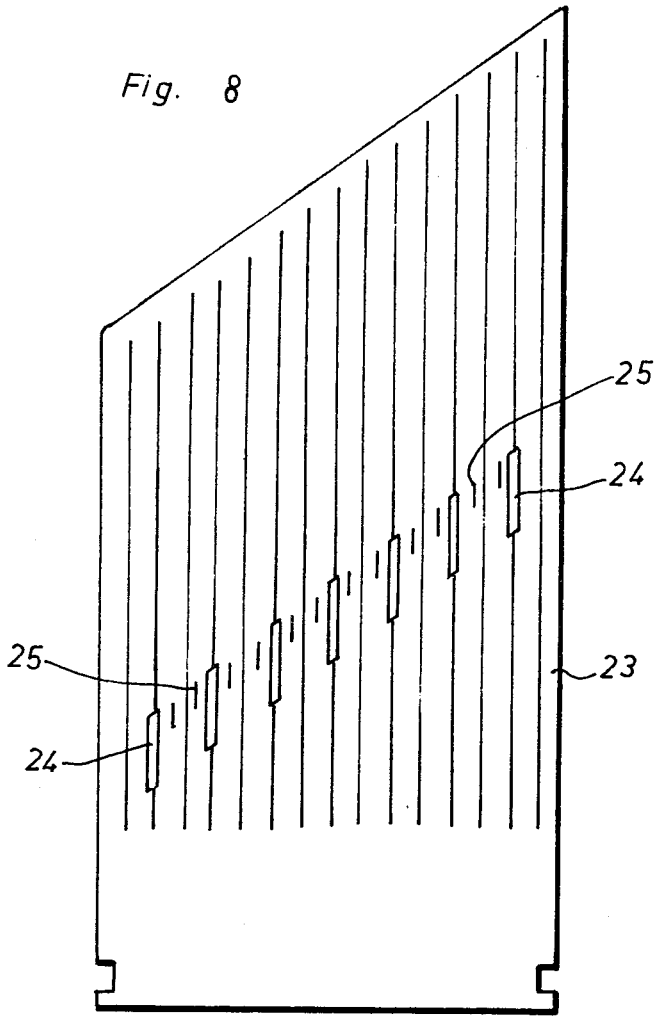
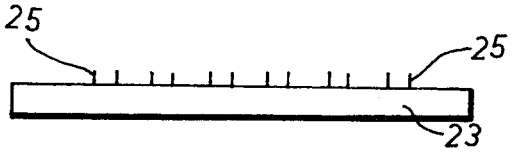
Fig. 9

Fig. 10
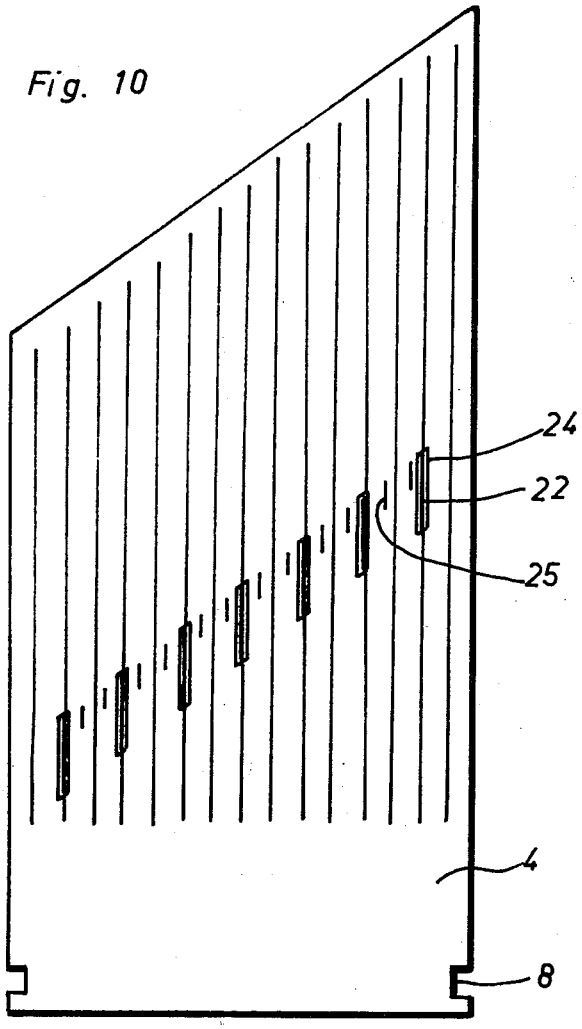
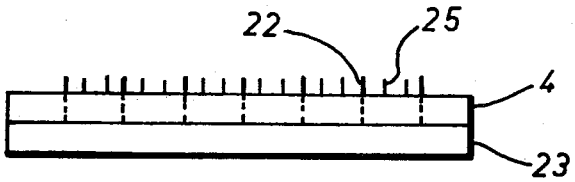
Fig. 11

Fig. 14
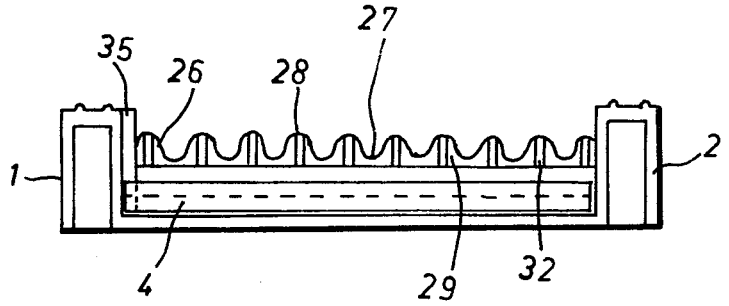
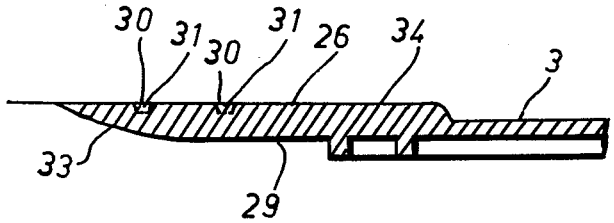
Fig. 15

VEGETABLE AND FRUIT-SLICING UTENSILS

BACKGROUND OF THE INVENTION

1. Field of the Invention

The present invention relates to pitcher utensils for cutting potatoes, vegetables, fruit and the like into portions such as slices, of the kind which comprises a back plate which is solidly connected to two parallel rails, a removable front plate which is arranged between the rails and whose surface lies parallel to and at a distance beneath and in front of the surface of the back plate, and a blade arranged between the two plates, at least part of whose cutting edge lies in the same plane as the surface of the back plate.

2. Prior Art

To allow slices of differing thicknesses to be cut, it is known to exchange the front plate of a slicer for a different one, thus altering the distance perpendicular to the direction of operation between the front plate and the cutting edge of the blade, which distance determines the thickness of the slices which are cut. There is a disadvantage however in that there has to be a special front plate for each depth of cut required, which makes the utensil very expensive to produce and very cumbersome to use.

It is also known to place a second fore-plate on the front plate in order once again to alter the depth of cut. Even with a utensil of this nature a large number of additional plates is needed. Yet again, it is known to use front plates with rails at the sides which project from the face of the plate so that slices of two different thicknesses can be obtained depending on which side of the plate is uppermost. If however slices of several thicknesses are required further plates once again become necessary.

SUMMARY OF THE INVENTION

It is therefore an object of the invention to provide a pitcher utensil of the kind hereinabove described in which different depths of cut can be set using only one removable front plate.

This and other objects are achieved by providing the underside of the removable front plate with bearers containing at least one step, which bearers are supported on ledges which project inwards from the rails on the back plate when the front plate is inserted.

Advantageously, the edges of the removable front plate have spaced cut-outs adjacent the rails in which cut-outs locking ribs arranged on the rails engage.

The distance between the cut-outs in the removable front plate is advantageously the same as the axial length of the steps on the bearers.

The bearers are preferably connected together by webs which extend across the width of the removable front plate. The webs and bearers are advantageously supported on transverse struts which are arranged between the rails and connect the rails together.

Advantageously, the transverse struts contain openings for the bearers, and the webs and the transverse struts advantageously extend parallel to the leading edge of the blade.

Spaced dividing blades, which stand up perpendicularly to the main blade and parallel to the direction of operation, may be arranged in the removable front plate. Advantageously, a bearing plate containing apertures for the dividing blades may be placed on the removable front plate, in which case further spaced dividing blades are arranged between the apertures in this bearing plate perpendicularly to the blade and parallel to the direction of operation.

In order that a thin corrugated blade may be used in such a kitchen utensil without the need for sharpending and so that this blade can be held firm and secure in the utensil, the back plate may have supporting ribs at its front edge which project into the space between the back and front plates. The rear part of the blade is solidly connected to the supporting ribs at the points where the crests of the corrugations are situated and to the back plate at the points where the troughs of the corrugations are situated.

Advantageously, the front ends of the supporting ribs taper in the direction of the blade.

The blade may have apertures in its crests, through which retainer portions of the supporting ribs engage, and guide ribs may be arranged among the supporting ribs, the lower edges of which extend obliquely downwards in the direction of operation.

Advantageously, the crests of the blade have continuing from them tapering guide ribs which lie flush with the crests and merge into the back plate.

The metal cutting blade may be arranged obliquely to the direction of operation, and it may be closely connected to the plastics supporting ribs.

In a preferred method of manufacture, the utensil is of plastic injection moulded in a simple operation onto the cutting blade which has been placed in the mould.

BRIEF DESCRIPTION OF THE DRAWINGS

In order that the invention may be more clearly understood, reference will now be made to the accompanying drawings which show some embodiments thereof by way of example and in which:

FIG. 6 is a plan view of a front plate with dividing blades, FIG. 7 is a front end view of the plate of FIG. 6, FIG. 8 is a plan view of a fore-plate with dividing blades, FIG. 9 is a front view of the fore-plate of FIG. 8, FIG. 10 is a plan view of the plates of FIGS. 6 and 8 placed on top of one another, FIG. 11 is a front end view of the plates which are shown on top of one another in FIG. 10, FIG. 14 is a front end view of the utensil of FIG. 12, and FIG. 15 is a sectional view of a guide rib taken on line IV—IV of FIG. 12.

DETAILED DESCRIPTION OF PREFERRED EMBODIMENT

Figure 1:
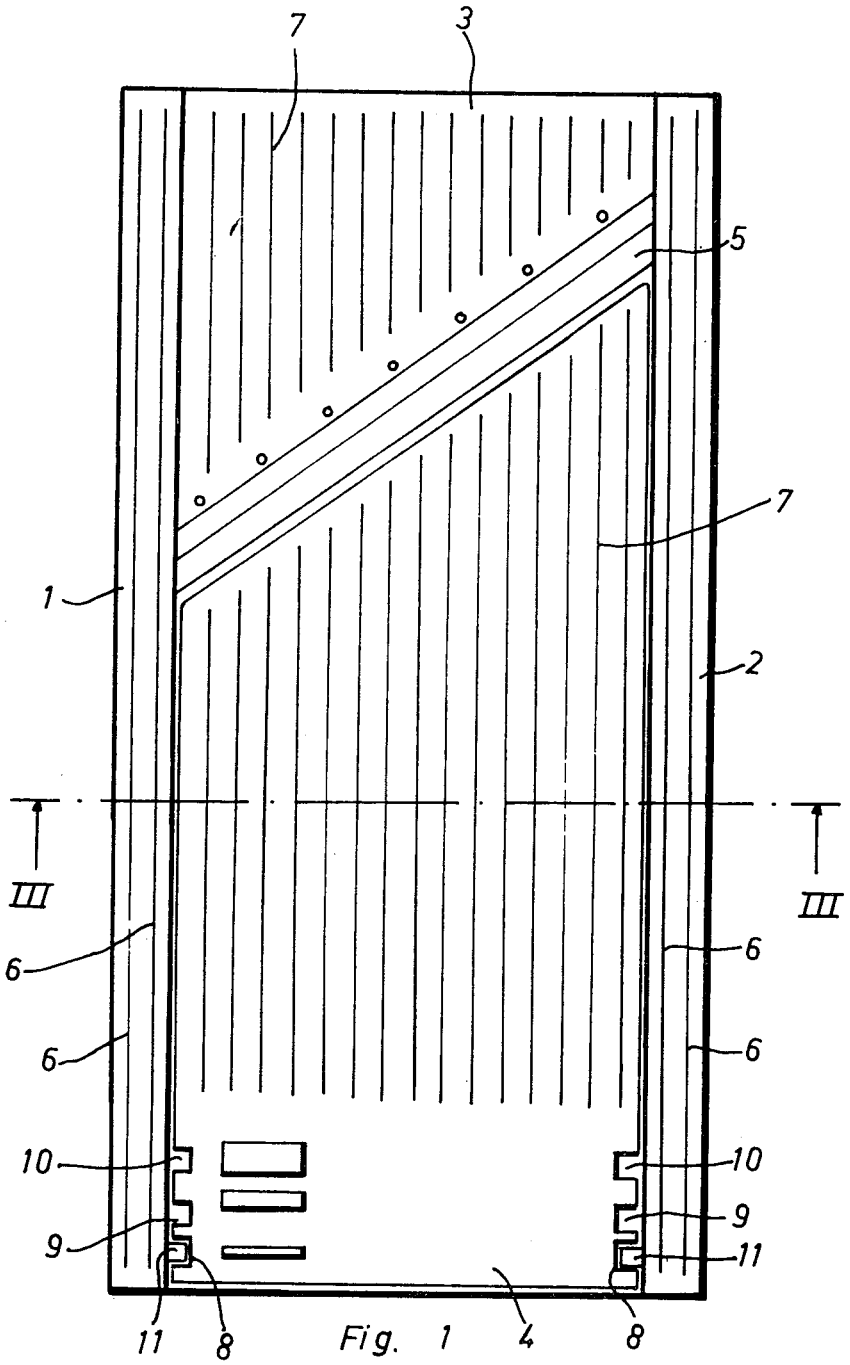
FIG. 1 is a plan view of a kitchen utensil with the front plate inserted.
Figure 2:
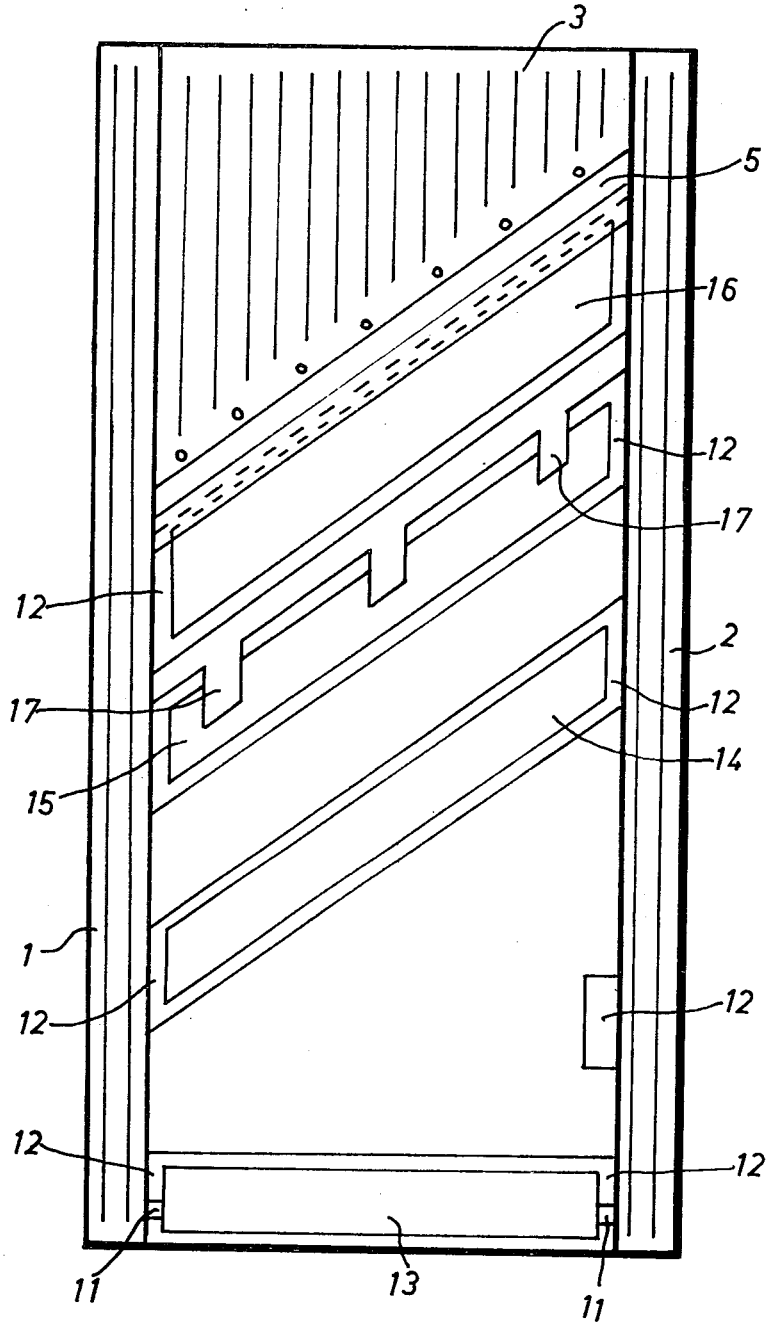
FIG. 2 is a plan view of the utensil with the front plate removed.
Figure 3:
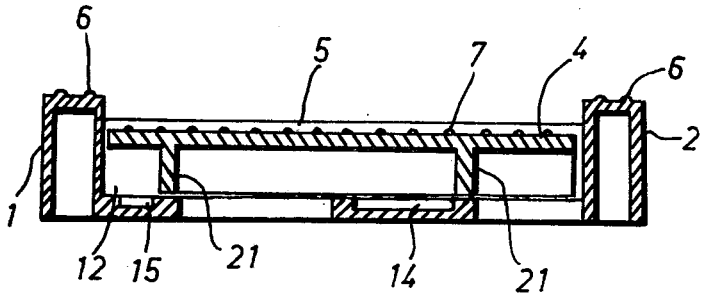
FIG. 3 is a sectional view of the utensil along the line III—III of FIG. 1.

Referring now to the drawings, the kitchen utensil shown in FIGS. 1, 2 and 3 has two parallel rails 1 and 2 to which a back plate 3 is solidly connected. Between the rails 1 and 2, which project forward from the back plate, is arranged a removable front plate 4, the surface of which lies parallel to and at a distance below and in front of the surface of the back plate 3. Between the two plates 3 and 4 is arranged a metal slicing blade 5, whose cutting edge lies in the same plane as the surface of the back plate 3.

On the rails 1 and 2 are arranged narrow ridges 6 while similar narrow ridges 7 are arranged on the plates 3 and 4. The ridges 7 on the plates serve to reduce friction against the fruit being cut, which is moved back and forth on the two plates. The ridges 6 on the rails 1 and 2 serve to reduce friction against a holder in which the fruit to be cut up is inserted and which is guided on the rails.

In FIG. 1 the front plate 4 has spaced cut-outs 8, 9 and 10 in its edges adjacent the rails 1 and 2. Locking ribs 11 arranged on the rails 1 and 2 are engaged in the cut-outs 8.

FIG. 2 shows supporting ledges 12 arranged to project inwardly from the rails 1 and 2. The rails 1 and 2 are connected together by transverse struts 13, 14, 15 and 16 with strut 15 containing apertures 17.

Figure 4:
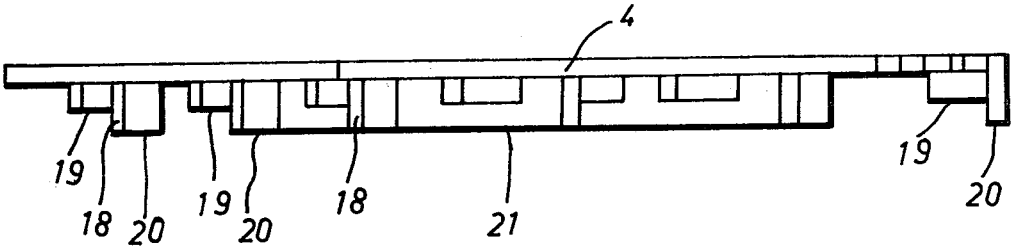
FIG. 4 is a side-view of a front plate alone.
Figure 5:
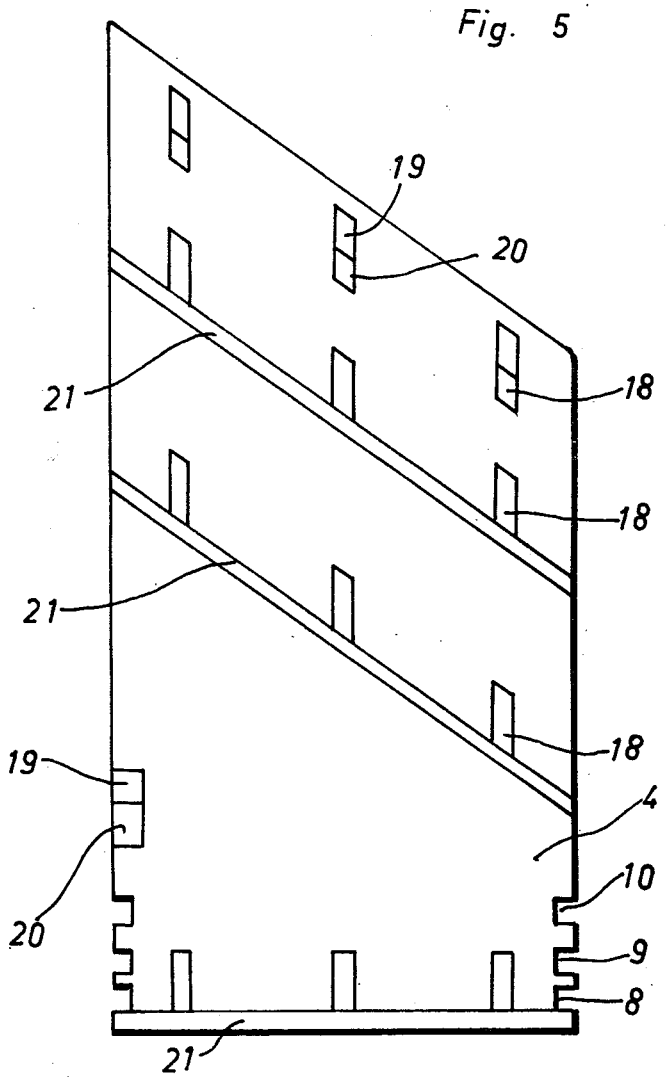
FIG. 5 is a view from below of a front plate.

As seen in FIGS. 4 and 5, the removable front plate 4 has bearers 18 containing steps 19 and 20 on their undersides. The higher steps 20 on the bearers 18 are connected together by webs 21 which extend across the width of the front plate 4.

In the position shown in FIG. 1, the front plate 4 lies in the utensil with cut-outs 8 engaged with the locking ribs 11. As a result the higher steps 20 on the bearers 18, or the webs 21 connecting the higher steps 20, as the case may be, rest on the supporting ledges 12 on the rails 1 and 2 and on the transverse struts 13 to 16. As a result the distance between the front plate 4 and the blade 5 in a direction perpendicular to the direction of operation is very small, thus allowing thin slices to be cut with the utensil.

If the front plate is now inserted in the utensil in such a way that the cut-outs 9 engage with the locking ribs 11 on the rails 1 and 2, the lower steps 19 on the bearers 18 rest on the supporting ledges 12 or the transverse struts 13 to 16, as the case may be, and the said perpendicular distance between the front plate 4 and the blade 5 increases accordingly. Finally, if the removable front plate 4 is inserted in the utensil with its cut-outs 19 engaged with the locking ribs 11 on the rails 1 and 2, the plate lies with its underside on the supporting ledges 12 on the rails 1 and 2 and on the transverse struts 13 to 16, thus making the said perpendicular distance between the front plate and the blade even greater.

In this way it is possible to set for different desired depths of cut using a single removable front plate, with the number of depths of cut which can be set depending on the number of steps on the bearers 18.

In FIGS. 6 and 7, a front plate 4 has spaced dividing blades 22 which stand up perpendicularly to blade 5 and parallel to the direction of operation. The plate 4 also contains cut-outs 8 which can be engaged with the locking ribs 11 when the plate is inserted in the utensil. In this way the utensil can also be used to cut fruit into dice by passing the fruit to be diced through the dividing blades 22 twice, in which case the fruit must be rotated after the first passage, and by then passing it through the blade 5.

In FIGS. 8 and 9, a further fore-plate 23 has apertures 24 for the dividing blades 22 of the front plate 4 of FIG. 6. Between the apertures 24, further spaced dividing blades 25 are arranged perpendicularly to the blade 5 and parallel to the direction of operation.

If the fore-plate 23 is placed on top of the front plate 4 as shown in FIGS. 10 and 11 and the pair is inserted in the utensil with cut-outs 8 engaged with the locking ribs 11, then the utensil can be used to cut the fruit to be diced into correspondingly smaller dice.

In the case of the embodiment shown in FIGS. 12 to 15, a corrugated blade 26 is obliquely arranged in the slot extending from one rail to the other between the back plate 3 and the front plate 4. The cutting edge of this blade contains crests 28 and troughs 27 which extend parallel to one another and to the rails 1, 2, the troughs 27 lying in the same plane as the surface of the back plate 3.

At its front edge, the back plate 3 has supporting ribs 29 which project into the slot and which are solidly connected to the rear part of the blade at the points where the crests of the corrugations are situated. In its crests the blade 26 has apertures 30 with curved-over rims. Retainer portions 31 of supporting ribs 29 which hold the blade 26 in place engage through these apertures 30. Apertures may also be provided in the troughs of the blade 26 for retainer portions of the rear support plate 3 to engage through.

The front ends of the supporting ribs 29 are formed to taper in the direction of the blade. Among the supporting ribs 29 are arranged guide ribs 32 whose undersides 33 extend obliquely downwards in the direction of operation. This makes it easier to guide the cut material downwards. Continuing from the crests 28 of blade 26 are guide ribs 34 which lie flush with the crests and which taper in the direction of operation and merge into the rear bearing plate.

The supporting ribs 29 provide secure and solid support for the thin blade 26, which preferably consists of 1/10 mm thick steel and which has no intrinsic rigidity in a direction transverse to the crests 28 and troughs 27. Also, during the operation of injection moulding the utensil, the plastics material makes its way through the apertures 30 and forms retainer portions 31, so that the blade 26 is closely connected to the plastics material of which the utensil is composed. Because of this it is possible to use unusually thin cutting blades, which do not have to be sharpened even after frequent use. Also the cutting ability of the blade is considerably increased by its oblique position.

Figure 13:
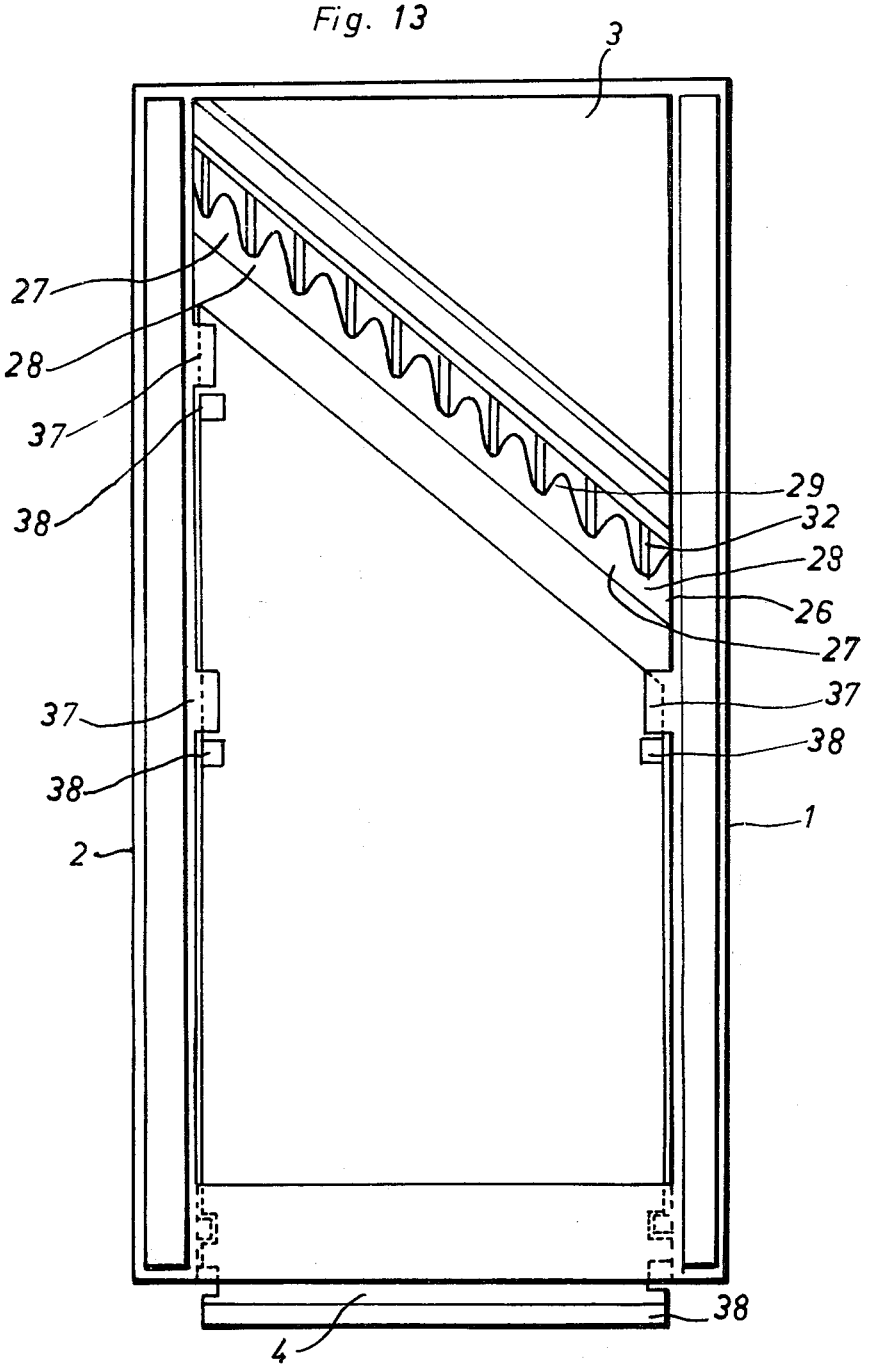
FIG. 13 is a view from below of the utensil of FIG. 12.

On the rails 1 and 2 are arranged locking ribs 35, which engage in cut-outs 36 in the front plate 4, and inwardly projecting supporting ledges 37 (FIG. 13). On its underside the front plate 4 has bearers 38.

Figure 12:
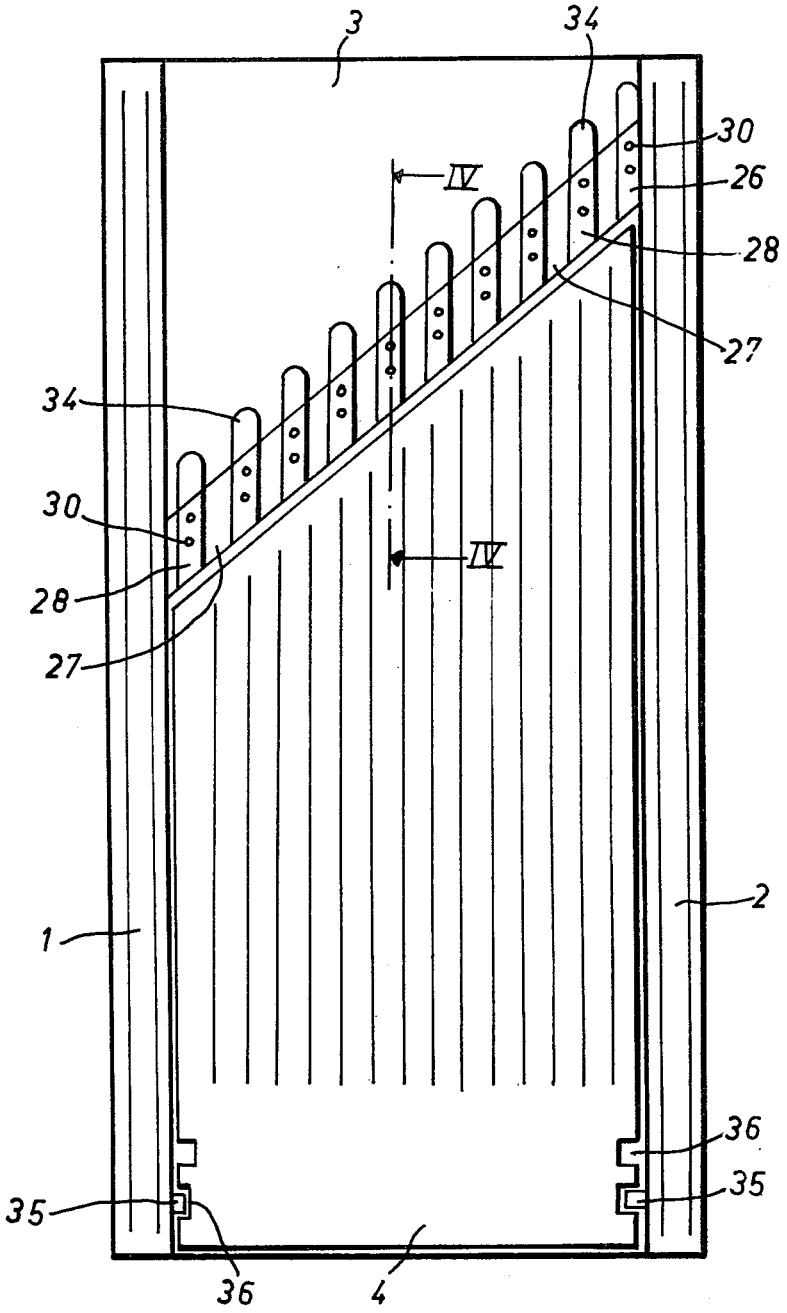
FIG. 12 is a plan view of a kitchen utensil having a corrugated blade, with the front plate inserted.

With the front plate 4 in the position shown in FIG. 12, the bearers 38 rest on the supporting ledges 37 on the rails 1 and 2 so that there is only a short distance between the cutting blade 26 and the front plate 4 in a direction perpendicular to the direction of operation.

With the front plate 4 in the position shown in FIG. 13, the underside of the plate rests on the supporting ledges 37 on rails 1 and 2, with the result that the distance between the blade and the front plate in a direction perpendicular to the direction of operation increases accordingly.

Depending on the distance in a direction perpendicular to the direction of operation between the blade and the front plate, the utensil can be used to cut a fruit into strips or into corrugated slices with or without lattice-like apertures.

I claim:

1. In a kitchen utensil for cutting vegetables, fruit and the like into portions such as slices, such utensil including two opposite rails, a back plate carried by the rails, a removable front plate between the rails having a surface generally parallel to and spaced from a surface of the back plate and a slicing blade between the two plates having a cutting edge at least part of which lies in the same plane as a surface of the back plate, the improvement comprising the removable front plate having on its underside bearers each containing at least one step, and supporting ledges projecting inwardly from the rails for supporting said bearers.

2. A kitchen utensil according to claim 1, wherein the removable front plate has in its edges adjacent the rails spaced cut-outs, and locking ribs arranged on said rails engageable in said cut-outs.

3. A kitchen utensil according to claim 2, wherein the distance between the cut-outs in the removable front plate is the same as the length of the steps of the bearers.

4. A kitchen utensil according to claim 1, wherein the bearers are connected by webs extending across the width of the removable front plate.

5. A kitchen utensil according to claim 4, wherein the webs and the bearers are supported on transverse struts between and connecting the rails.

6. A kitchen utensil according to claim 5, wherein some of the transverse struts are apertured to receive the bearers.

7. A kitchen utensil according to claim 5, wherein the webs and transverse struts extend parallel to the leading edge of the blade.

8. A kitchen utensil according to claim 1, including spaced parallel dividing blades on the front plate projecting perpendicularly to the slicing blade.

9. A kitchen utensil according to claim 8, including a fore-plate on top of the removable front plate having apertures for receiving dividing blades, and other spaced dividing blades located between the fore-plate apertures.

10. A kitchen utensil according to claim 1, including supporting ribs on the back plate projecting into the space between the back plate and the removable front plate, the rear part of the slicing blade being corrugated, the crests and troughs of the slicing blade corrugations extending parallel to the rails, said supporting ribs being connected to crests of the rear part of the slicing blade and the back plate being connected to troughs of the slicing blade.

11. A kitchen utensil according to claim 10, wherein the front portions of the supporting ribs are tapered transversely of the slicing blade.

12. A kitchen utensil according to claim 10, wherein the slicing blade crests and troughs have apertures, and retainer portions carried by the supporting ribs and engaged in such apertures.

13. A kitchen utensil according to claim 10, including guide ribs beneath the slicing blade having lower edges extending obliquely downwards from the slicing blade.

14. A kitchen utensil according to claim 10, including guide ribs beneath the slicing blade, projecting therefrom flush with the crests, tapering downward from the slicing blade and merging into the back plate.

15. A kitchen utensil according to claim 10, wherein the slicing blade is arranged obliquely relative to the rails.

16. A kitchen utensil according to claim 10, wherein the slicing blade is closely connected to the supporting ribs.

17. A kitchen utensil according to claim 1, including a suitable molded plastic material in which the slicing blade is embedded.

18. A kitchen utensil according to claim 1, in which the slicing blade is thin and rigidly supported by the back plate.

19. A kitchen utensil according to claim 18, in which the back plate is plastic material and at least part of the slicing blade is embedded in the back plate.

20. A kitchen utensil according to claim 19, in which the back plate is injection-molded in contact with the slicing blade so that the slicing blade is closely connected to the back plate.

* * * * *

UNITED STATES PATENT AND TRADEMARK OFFICE

CERTIFICATE OF CORRECTION

PATENT NO. : 4,120,089
DATED : October 17, 1978
INVENTOR(S) : Alfred Börner

It is certified that error appears in the above-identified patent and that said Letters Patent are hereby corrected as shown below:

Title page, [57] Abstract, first line, after "has" insert --a back plate solidly connected to--.

Column 1, line 6, cancel "pitcher" and insert --kitchen--; line 40, cancel "pitcher" and insert --kitchen--.

Column 2, line 28, insert a comma after "plastic".

Signed and Sealed this

*Twentieth* Day of *February 1979*

[SEAL]

*Attest:*

RUTH C. MASON
*Attesting Officer*

DONALD W. BANNER
*Commissioner of Patents and Trademarks*